US008832987B2

(12) United States Patent
Addis

(10) Patent No.: US 8,832,987 B2
(45) Date of Patent: Sep. 16, 2014

(54) SYSTEMS AND METHODS FOR AIDING THE INSERTION OF DETACHABLE FIREARM MAGAZINES

(76) Inventor: Michael A. Addis, Hayward, CA (US)

( * ) Notice: Subject to any disclaimer, the term of this patent is extended or adjusted under 35 U.S.C. 154(b) by 149 days.

(21) Appl. No.: 13/282,428

(22) Filed: Oct. 26, 2011

(65) Prior Publication Data

US 2013/0104440 A1 May 2, 2013

(51) Int. Cl.
*F41A 9/65* (2006.01)
*F41A 17/38* (2006.01)

(52) U.S. Cl.
CPC ..... *F41A 17/38* (2013.01)
USPC ..... 42/90; 42/49.01

(58) Field of Classification Search
USPC ..... 42/90, 106, 49.01, 50
See application file for complete search history.

(56) References Cited

U.S. PATENT DOCUMENTS 4,430,821 A * 2/1984 Vincent ..... 42/50
4,484,404 A * 11/1984 Johnson ..... 42/90
7,823,312 B2 * 11/2010 Faifer ..... 42/49.02
8,127,480 B1 * 3/2012 McManus et al. ..... 42/49.02

* cited by examiner

*Primary Examiner* — Daniel J Troy
(74) *Attorney, Agent, or Firm* — Kang S. Lim

(57) ABSTRACT

The present invention relates to systems and methods for aiding the insertion of detachable magazines in AK rifle variants. The magazine well attachment includes a well attachment body having a slit configured to slide over a trigger guard of a firearm during the assembly process. The attachment body includes a beveled well opening for guiding a tilt-lock magazine into the firearm. The beveled well opening includes beveled steps for funneling and centering the magazine during insertion and also includes an angled front well ramp for guiding the magazine into the rifle at an appropriate angle. In order to accommodate the dimensional variances between receivers made by different manufacturers, a front retainer secures the attachment to the magazine opening. The magazine well attachment also includes a rear overhang secured to a ledge of the firearm's trigger guard.

10 Claims, 12 Drawing Sheets

SYSTEMS AND METHODS FOR AIDING THE INSERTION OF DETACHABLE FIREARM MAGAZINES

BACKGROUND

The present invention relates to systems and methods for aiding the insertion of detachable magazines in firearms. Accessories for firearms have increased steadily over time in both functionality and flexibility, and today, there is a wide variety of firearm accessories available including detachable magazine accessories.

To accomplish an efficient and reliable loading and/or reloading of a firearm, the detachable magazine has to be securely seated in the correct orientation, and this loading/reloading process should preferably be performed solely by feel, i.e., without the user having to look down at the firearm or at the magazine. Loading/reloading by feel enables the user to keep his/her eyes downrange which is very important in tactical situations, such as when a police officer is engaging a suspect during a bank robbery.

The inventor of the Avtomat Kalashnikova (AK) type of rifles, also commonly known as a Kalashnikov rifle (named after the inventor), had as his primary design goals exceptional reliability in the field and very low manufacturing cost. As a result, functionality was compromised including long-range accuracy and ease of loading and reloading. For example, the AR rifles, e.g., the Colt AR-15, are inherently more accurate and easier to reload than the AK rifles.

Loading an AK rifle variant requires initial insertion of the magazine into a straight-walled magazine opening, engaging the front magazine tab to the rifle, and then rotating the magazine rearward to engage the rear magazine tab into the rifle's magazine latch. Hence, loading and reloading an AK requires a lot of manual dexterity and the difficulty of a speed load or reload increases exponentially under stress.

It is therefore apparent that an urgent need exists for an AK magazine well attachment to aid the insertion of detachable magazines in AK rifle variants. This improvement enables users to quickly and easily complete a load or reload of an AK rifle without error, especially in stressful situations.

SUMMARY

To achieve the foregoing and in accordance with the present invention, systems and methods for aiding the insertion of detachable magazines in firearms are provided. In particular, a magazine well attachment is provided for AK rifle variants to guide the insertion of detachable magazines.

One embodiment of the magazine well attachment includes a well attachment body having a slit configured to slide over a trigger guard of a firearm during the assembly process. The attachment body also includes a beveled well opening configured to guide a tilt-lock magazine into a magazine opening of the firearm.

In order to accommodate the dimensional variances between receivers made by different manufacturers, a front retainer, e.g., a metal C-shaped clip, is fastened to the front of the magazine well attachment and is configured to secure the attachment to a front portion of the magazine opening of the firearm. The magazine well attachment also includes at least one rear overhang configured to secure the attachment to a ledge of the firearm's trigger guard.

In some embodiments, the magazine well body includes a pair of beveled steps configured to funnel and center the magazine during insertion, and also includes an angled front well ramp configured to guide the magazine into the rifle at an appropriate angle.

It is also possible to include additional functionality to the magazine well attachment. For example, a magazine latch shield can be coupled to or incorporated into the magazine well body to prevent the magazine latch from being activated by the user's fingers.

Note that the various features of the present invention described above may be practiced alone or in combination. These and other features of the present invention will be described in more detail below in the detailed description of the invention and in conjunction with the following figures.

BRIEF DESCRIPTION OF THE DRAWINGS

In order that the present invention may be more clearly ascertained, some embodiments will now be described, by way of example, with reference to the accompanying drawings, in which.

DETAILED DESCRIPTION

The present invention will now be described in detail with reference to several embodiments thereof as illustrated in the accompanying drawings. In the following description, numerous specific details are set forth in order to provide a thorough understanding of embodiments of the present invention. It will be apparent, however, to one skilled in the art, that embodiments may be practiced without some or all of these specific details. In other instances, well known process steps and/or structures have not been described in detail in order to not unnecessarily obscure the present invention. The features and advantages of embodiments may be better understood with reference to the drawings and discussions that follow.

Figure 1A:
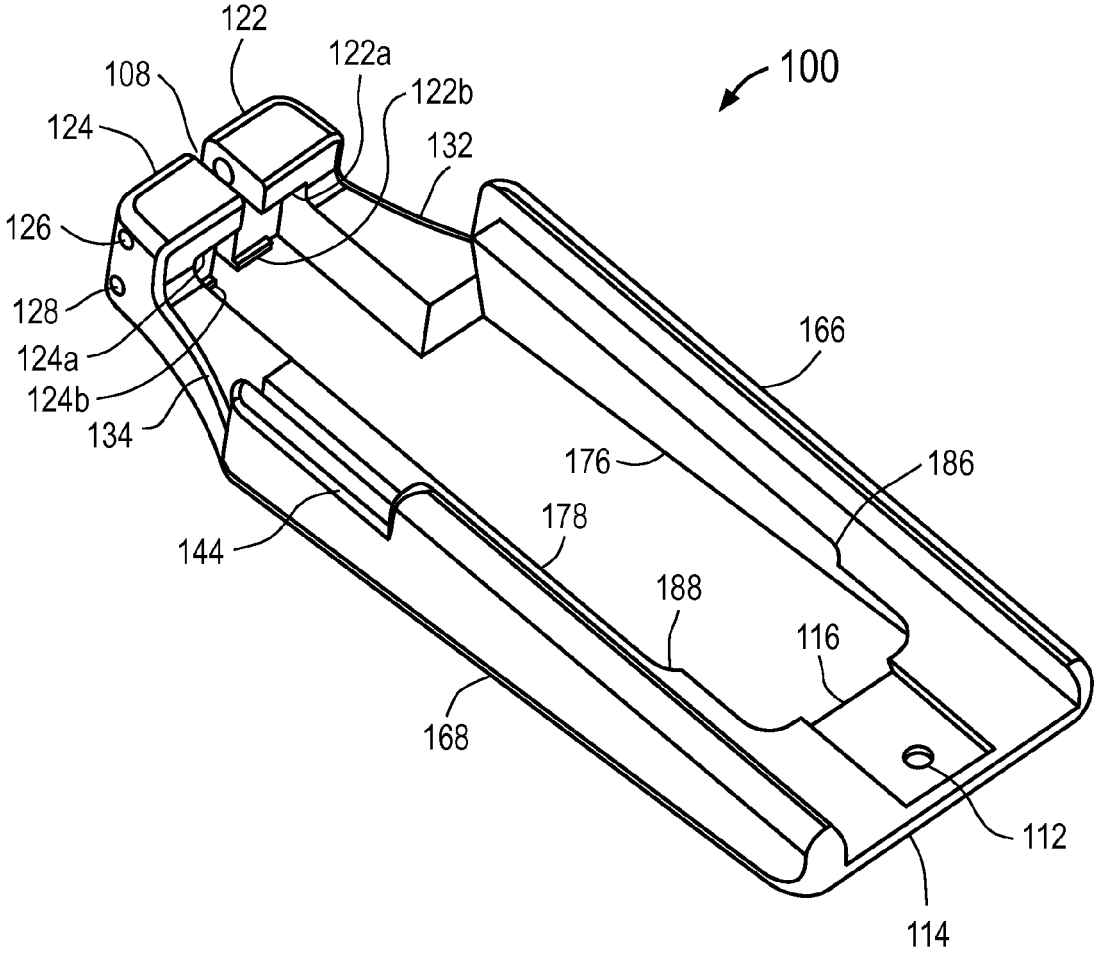
FIGS. 1A and 1B are top and bottom isometric views of a magazine well attachment in accordance with one embodiment of the present invention.
Figure 1B:
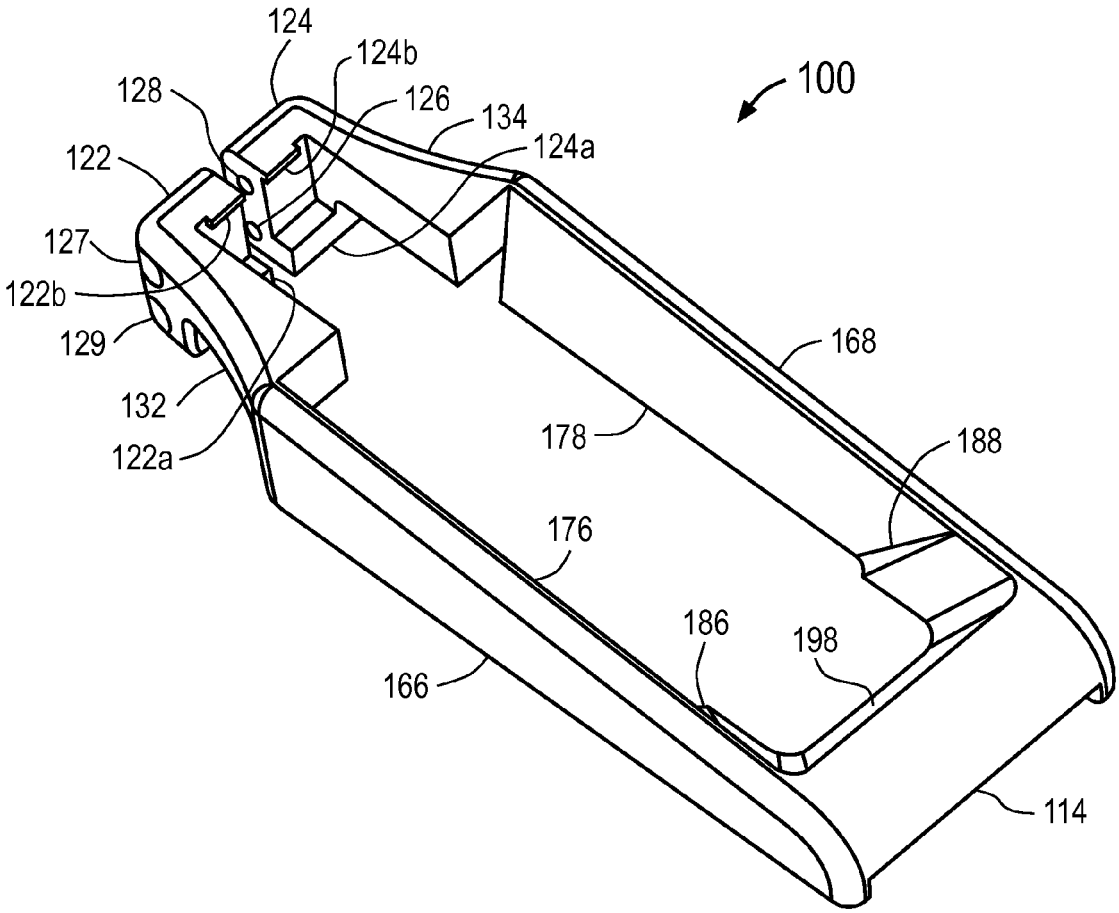
Figure 2:
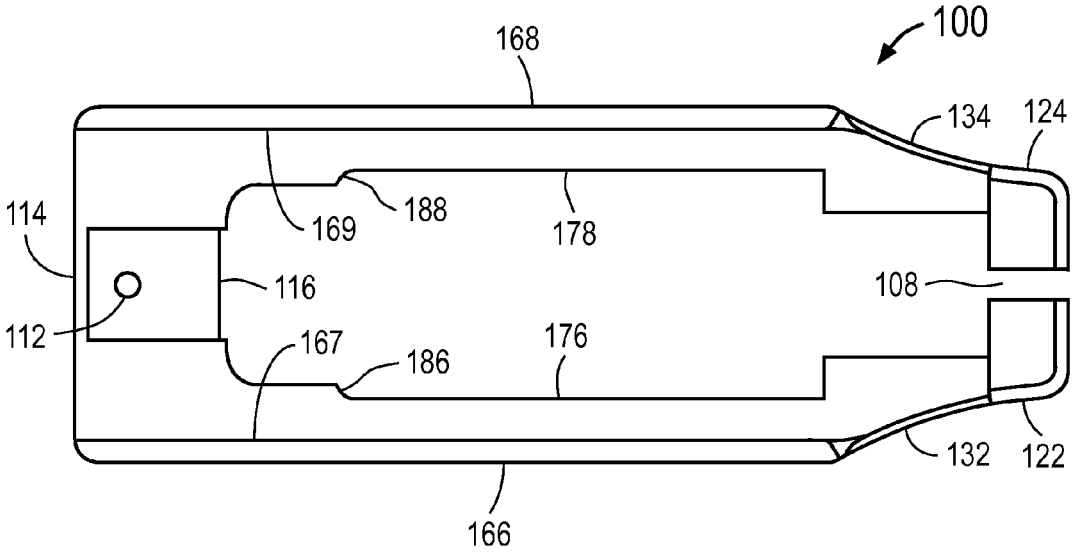
FIG. 2 is a top view of the embodiment of FIG. 1A.
Figure 3:
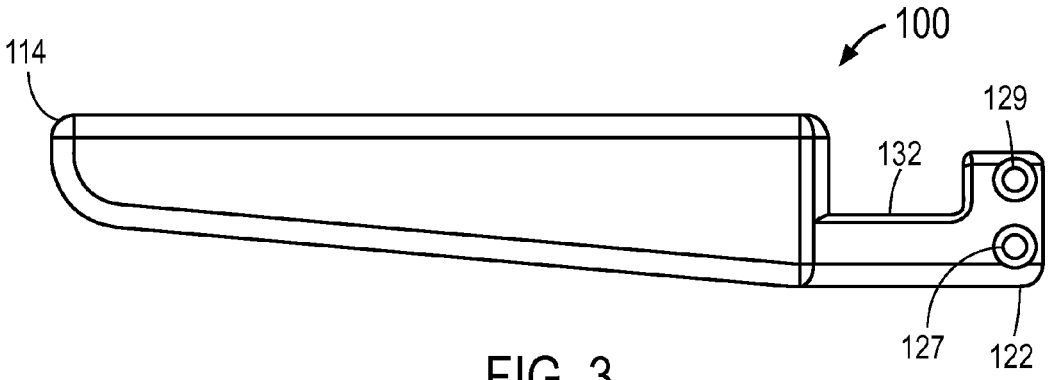
FIG. 3 is a left side view of the embodiment of FIG. 1A.

The present invention relates to systems and methods for aiding the insertion of detachable magazines in AK rifle variants. To facilitate discussion, FIGS. 1A and 1B are top and bottom isometric views of a magazine well (magwell) attachment 100 in accordance with one embodiment of the present invention. FIGS. 2, 3, 4 and 5 are the top view, left side view, right side view and front view, respectively, of magwell attachment 100. In this embodiment, magwell attachment 100 includes trigger guard grips 122, 124, magazine latch grips 132, 134, magwell walls 166, 168, and front receiver latch 114.

Magwell attachment 100 can be manufactured from a variety of suitable materials, including polymers such as glassreinforced chemical-resistant nylon, and metals such as aluminum. Ideally, the material is able to flex a little to make the installation a bit easier and to ensure a tighter fit. Depending on the material selected for manufacturing magwell attachment 100, suitable methods for forming attachment 100 include injection molding, die casting, and/or machining.

Figure 6:
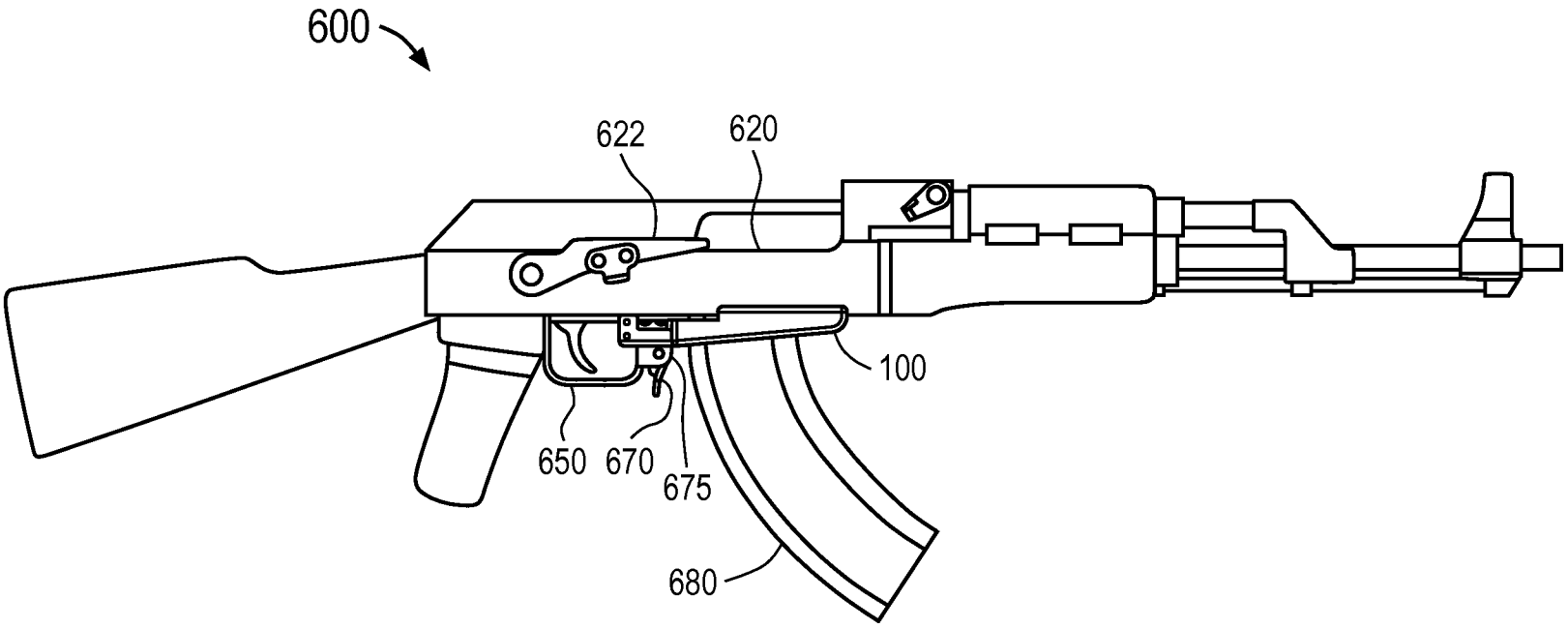
FIG. 6 illustrates the embodiment of FIG. 1A attached to a receiver of a Avtomat Kalashnikova (AK) variant rifle.

FIG. 6 illustrates the magwell attachment 100 attached to a receiver 620 of an Automat Kalashnikova (AK) variant rifle 600, also commonly known as a Kalashnikov rifle (named after the inventor). The AK variants include semi-automatic and select-fire variants such as the AK-47. The embodiments of the present invention are also applicable to other long guns using "insert-tilt-lock" type of detachable magazines, including both rifles and shotguns such as the Ruger mini-14, the Springfield Armory M1A, the IMI Galil, and the Saiga 12 shotgun.

Figure 7A:
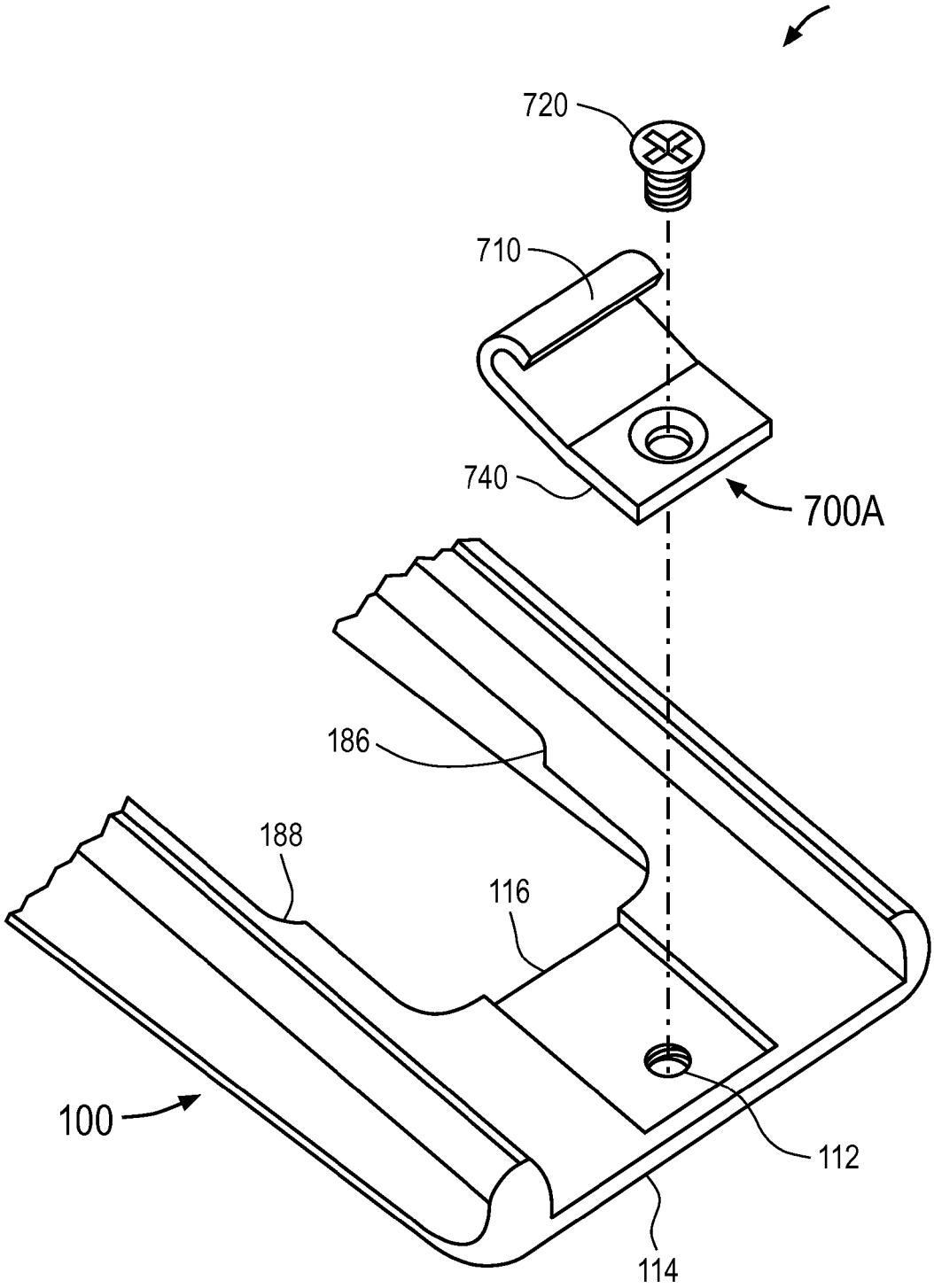
FIGS. 7A and 7B are isometric views showing two exemplary retaining clips for attaching the magazine well attachment of FIG. 1A to the rifle of FIG. 6.
Figure 7B:
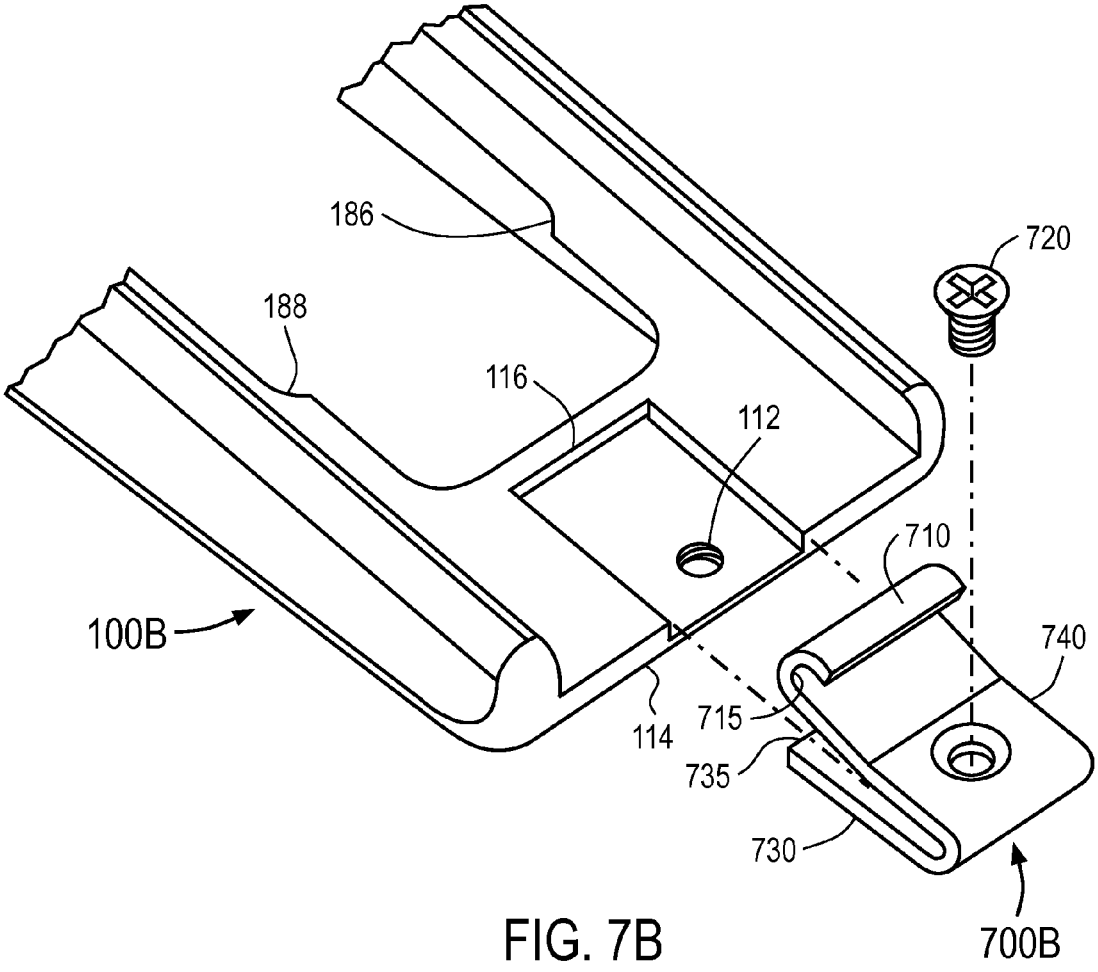

Referring to FIGS. 7A and 7B, two alternate embodiments of retaining clips, a C-shaped clip 700A and an S-shaped clip 700B, are shown. In FIG. 7A, C-shaped clip 700A is seated into a shallow pocket 116 of magwell 100, and then fastened with countersunk screw 720. Alternatively, as shown in FIG. 7B, the front edge 114 and shallow pocket 116 of magwell 100 is wedged between plates 730, 740 of S-shaped clip 700B, and then fastened with countersunk screw 720.

As discussed above, a key design goal of the AK rifle variants is very low manufacturing complexity and costs, resulting in the receiver 620 of rifle 600 having a relatively wider range of acceptable tolerances. In addition, AK rifles are manufactured by a wide variety of American, European and Asian manufacturers, and are available with stamped sheet metal receivers or with milled receivers resulting in a large spread of dimensional tolerances. Hence difference profiles of retaining clips 700A or 700B can be provided to accommodate these dimensional variations of the different receivers.

Magwell attachment 100 can be operatively attached to rifle receiver 620 in the following manner. Referring to isometric view FIG. 1A and side view FIG. 6, rifle 600 is positioned with the right side of the rifle 600 facing the user as shown in FIG. 6. Magwell attachment 100 is oriented so that a slit 108 located between the trigger guard grips 122, 124 is now substantially parallel with respect the rifle 600, and hence also substantially parallel to the bottom of trigger guard 650.

Trigger guard grip 124 is inserted inside the trigger area enclosed by trigger guard 650, just above the bottom of trigger guard 650, thereby causing trigger guard 650 to slide into and through the slit 108 between trigger guard grips 122, 124. Trigger guard grips 122, 124 are now clear of the trigger guard 650, and trigger guard 650 is now looped inside magwell attachment 100 and located loosely between magwell walls 166, 168.

Figure 4:
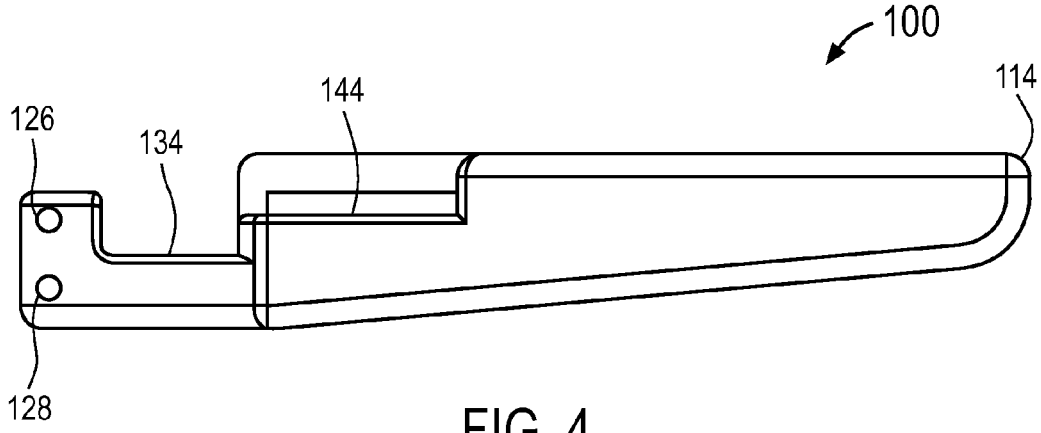
FIG. 4 a right side view of the embodiment of FIG. 1A.
Figure 5:
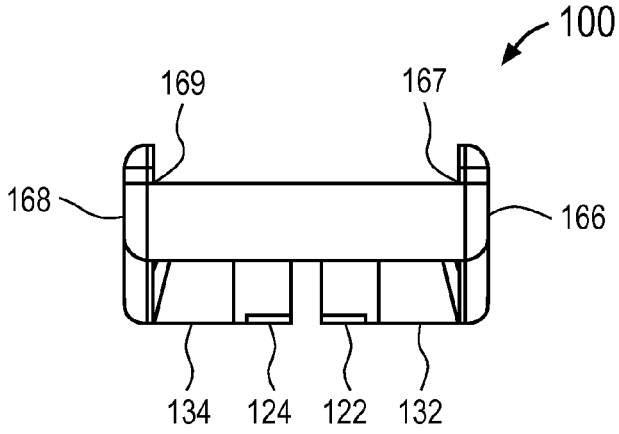
FIG. 5 front view of the embodiment of FIG. 1A.

The magwell attachment 100 can now reoriented as shown in the right side view of FIG. 4, by sliding the attachment 100 toward the muzzle of rifle 600, and seating the attachment 100 to the bottom of rifle 600 as shown in FIG. 6. When magwell attachment 100 is properly seated to receiver 620, ledges 167, 169 of magwell attachment 100 are in contact with the outside edges of receiver 620.

Figure 8:
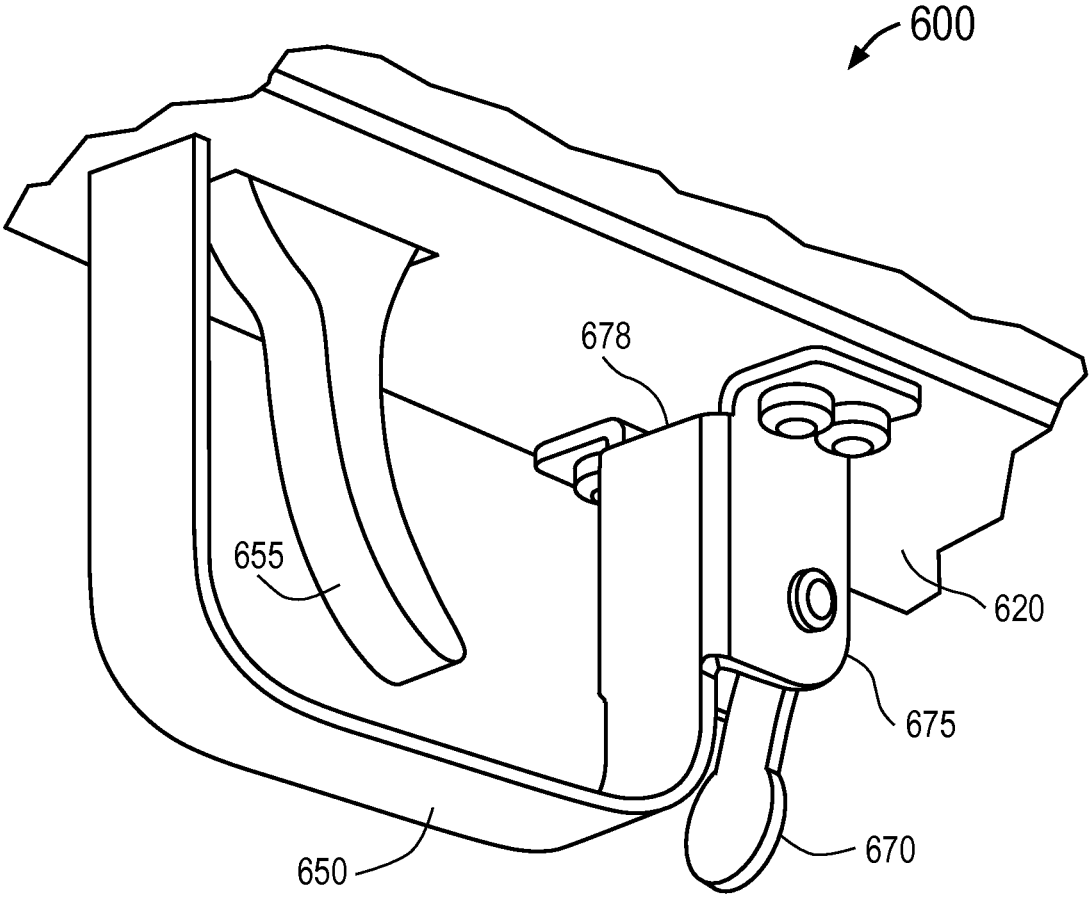
FIG. 8 is an isometric view illustrating the trigger guard area of the AK rifle of FIG. 6.

As shown in FIGS. 1A, 1B and also FIG. 8, magwell attachment 100 includes rear overhangs 122*a*, 124*a* while the front top section of trigger guard 650 forms a ledge 678 adjacent to magazine latch housing 675. As magwell attachment 100 is slid forward towards its seated location relative to rifle receiver 620, rear overhangs 122*a*, 124*a* dovetails into the space between trigger guard ledge 678 and the bottom of receiver 620, thereby securing the rear portion of the attachment 100 to rifle receiver 620.

Referring also to FIG. 7A, as magwell attachment is slid forward towards its seated location, retaining clip 700A, which has previously been securely attached to the shallow pocket 116 located proximate to the front 114 of magwell attachment 100, also engages the front edge of the magazine opening (not shown) of rifle receiver 620, thereby securing the front portion of the attachment to receiver 620.

Alternate mounting techniques to clips 700A, 700B are also possible. For example, while adding a retaining clip 700A increases the adaptability of magwell attachment 100 to different rifle variants, it is also possible replace clip 700A with a slightly oversized integral front magwell overhang (not shown) configured to engage the corresponding front edge of the magazine opening of receiver 620. Such an oversized front overhang can then be custom-fitted to the specific dimensions of a specific rifle receiver.

In addition, optional shim(s) can also be incorporated into a custom fitting process, at one or more mating locations between magwell attachment 100 and rifle receiver 620. For example, as shown in FIG. 1A, oversized trigger guard shims 122*b*, 124*b* can be provided to be custom fitted to accommodate trigger guard dimensional variations of the different rifle receivers.

As shown in FIG. 6, the top of magwell attachment 100 is now seated to the bottom of magazine opening of receiver 620. When magwell attachment 100 is properly seated to receiver 620, ledges 167, 169 of magwell attachment 100 are in contact with the outside edges of receiver 620.

In this seated configuration, cutouts on the respective tops of magazine latch grips 132, 134 clears the receiver mounting bracket of magazine latch housing 675, with magazine release lever 670 protruding below magwell attachment 100. Safety lever cutout 144 of magwell attachment 100 also clears safety lever 622 of rifle 600.

The magwell attachment 100 can be firmly secured into this seated position to rifle 600 by inserting a pair of screws through recessed holes 127, 129 and then tightening the screws inside threaded holes 126, 128, thereby narrowing the slit 108 between trigger guard grips 122, 124, now located behind trigger guard 650.

Narrowing the slit 108 between trigger guard grips 122, 124 provide sufficiently contact pressure between magazine latch grip 132 and 134 on opposing sides of magazine latch housing 675 to prevent slippage of magwell attachment 100 away from its properly seated configuration relative to rifle receiver 620 during use.

Advantages provided to rifle 600 by magwell attachment 100 include ease of initial insertion of a magazine 680, and superior alignment of the magazine 680 prior to the latching of the magazine to the receiver 620. These improvements are possible because in most AK rifle variants, the internal walls of the magazine opening are substantially parallel. As a result, the magazines have to be inserted while pre-aligned vertically with very little room for error, potentially causing critical delays under stressful loading and reloading of rifle 600.

Referring again to FIGS. 1A, 1B and 2, the internal walls 176, 178 of magwell attachment 100 are beveled, i.e., the mouth width of magwell attachment 100 is wider than the magazine opening of the receiver 620, thereby easing of initial insertion of the magazine 680 into the rifle 600 through attachment 100. Note that front well ramp 198, which is angled at approximately 47.7 degrees from the horizontal receiver well opening, provides the proper insertion angle for guiding magazine 680 as it is inserted through magwell attachment 100 and into the magazine opening of the receiver 620.

Once the magazine 680 has been inserted into the receiver 620, beginning with the magazine top tilted slightly backward, the front notch of the magazine 680 is mated with a corresponding engagement point in the magazine opening of receiver 620 by tilting the magazine 680 slightly forward. Beveled steps 186, 188 of magwell attachment 100 serve as a funnel, centering and guiding the magazine 680 during the mating process.

Next, using this corresponding engagement point as a pivot, the bottom of magazine 680 is then rotated rearward towards the butt stock causing a rear notch of magazine 680 to engage with a corresponding latch of receiver latch 675. Magazine 680 is now operatively coupled to rifle 600, with the magwell attachment 100 providing additional stability.

Note that while the AK design uses a (male) engagement notch for the front of the magazine, a (female) engagement depression or hole can also be used for the magazine, for example, the Ruger mini-14 and Springfield Armory MIA magazines have an engagement hole in the front of their magazines instead of a notch.

Figure 9A:
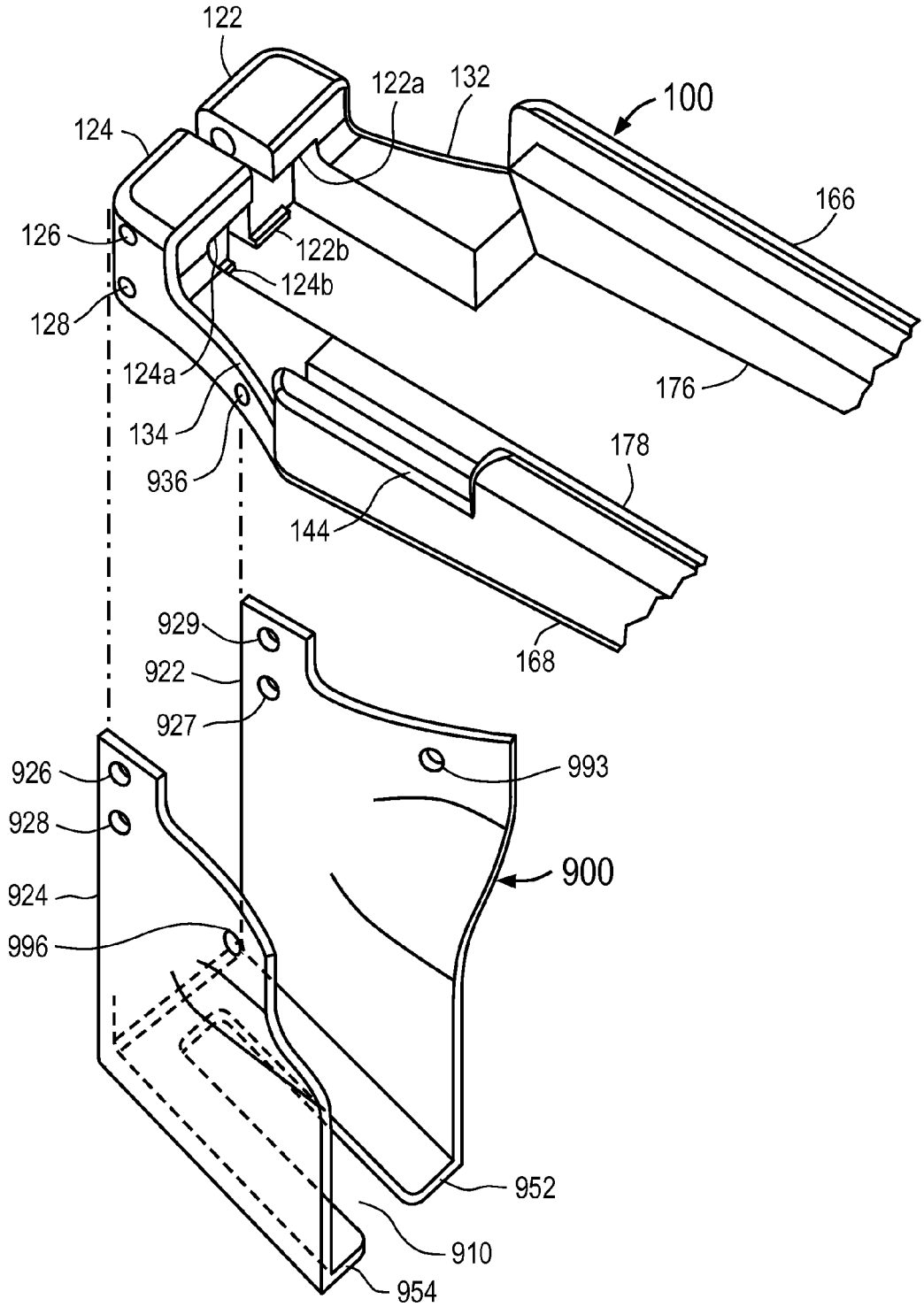
FIGS. 9A-9C are isometric, side and bottom exploded views of another embodiment of FIG. 1A with an optional magazine latch shield.
Figure 9B:
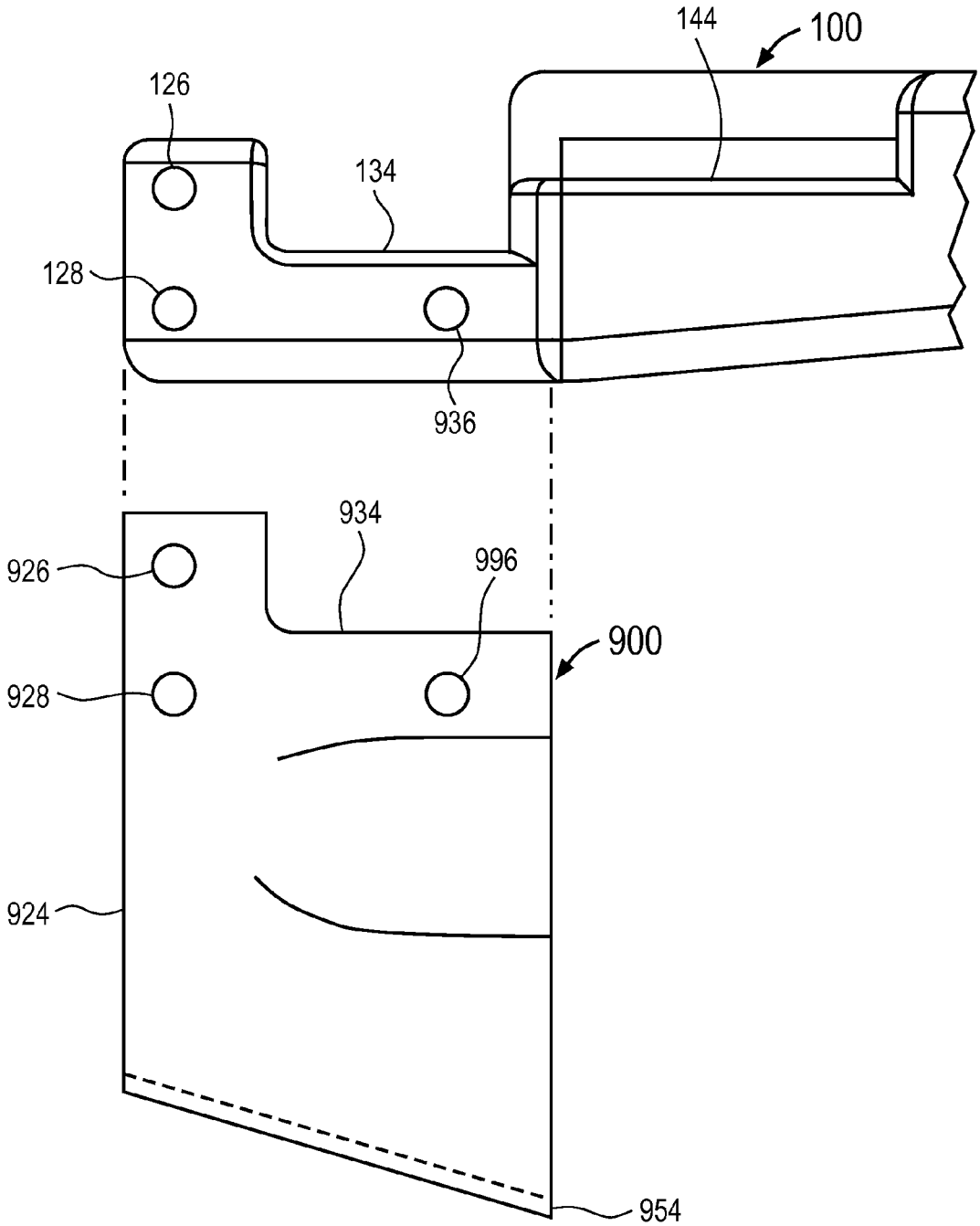
Figure 9C:
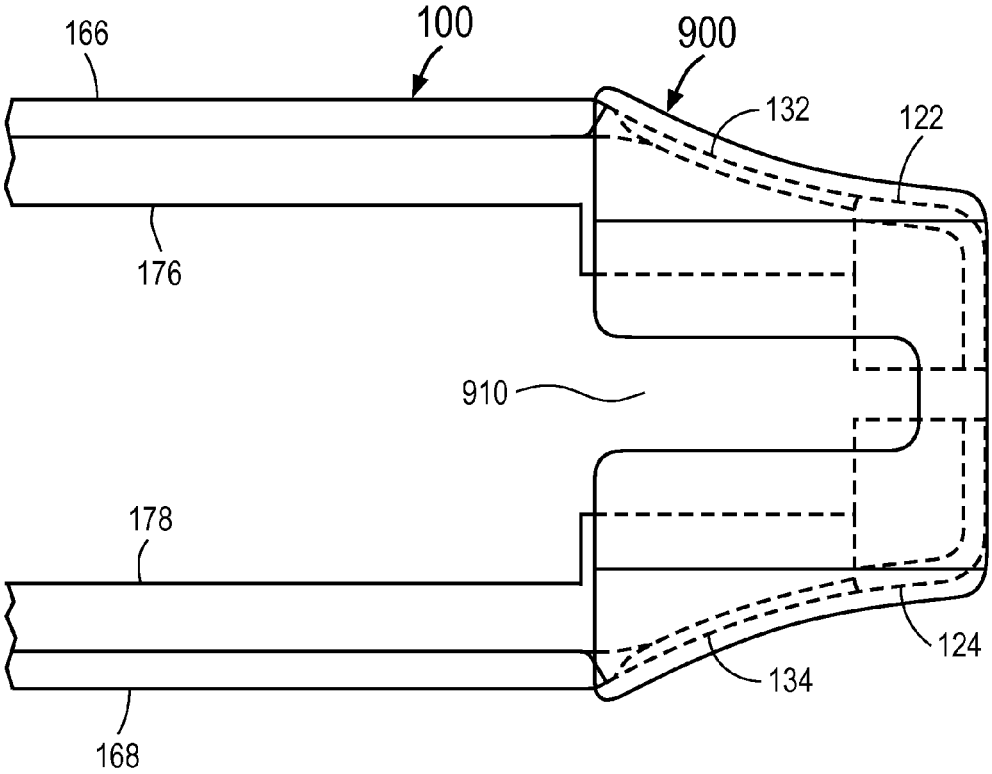
Figure 9D:
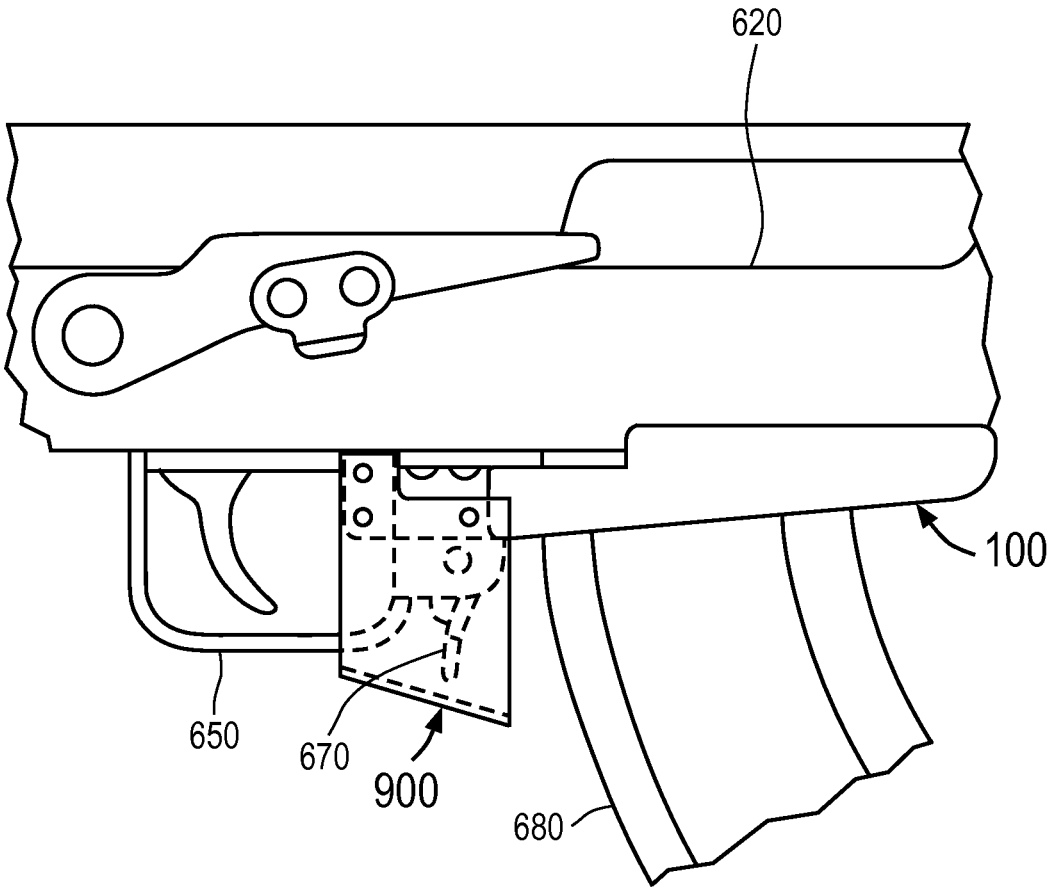
FIG. 9D is an assembled view of showing the embodiment of FIG. 9A attached to the rifle of FIG. 6.

FIGS. 9A-9D illustrate another embodiment of a magwell attachment 100 with an optional magazine latch shield 900. FIGS. 9A-9C are isometric, side and bottom exploded views of attachment 100 with shield 900, while FIG. 9D shows an assembled view of magwell attachment 100 properly seated to a rifle receiver 620, with a magazine latch shield 900 operatively coupled to attachment 100 via screw holes 926, 928, 996 and screw holes 927, 929, 993.

In this embodiment, magazine latch shield 900 includes a pair of side plates 922, 924 extending in a direction away from rifle receiver 620, and together with a bottom slotted plate 952, 954 substantially shields magazine release lever 670. Shield slot 910 is narrow enough to prevent a finger from accessing magazine release lever 670, and wide enough to allow a rifle cartridge tip to be inserted into the slot to activate magazine release lever 670.

The resulting configuration prevents magazine 680 from being detached without by hand thereby necessitating the use of a tool, such as a rifle cartridge, to activate magazine release lever 670 for magazine detachment. Such a shield 900 is useful in jurisdictions with firearm regulations restricting the possession and operation of semi-automatic long guns with detachable magazines.

Many forms of magwell attachment 100 are also possible. For example, instead of a two-piece embodiment illustrated by, for example, FIG. 7A or 7B, with a separate main magwell body 100 or 100B and a separate front clip 700A or 700B, a one-piece design (not shown) is also possible, i.e., a magwell attachment with an integral front ledge replacing front retaining clip 700A. Similarly, instead of a three-piece embodiment illustrated by FIGS. 9A-9D, with a separate main magwell body 100, a front retaining clip 700A and a magazine latch shield 900, a one-piece design (not shown) is also possible, i.e., a magwell attachment with an integral front ledge and an integral magazine latch shield. These one-piece implementations can be molded from a polymer or cast from a metal, or machined from a polymer or metal.

Other alternate multifunctional magazine well embodiments are also contemplated. For example, it is possible to manufacture a multifunctional trigger guard which has a magazine well extension integrated as a one-piece design (not shown). Also possible is a multifunctional trigger guard that has both a magazine well extension and a magazine latch shield integrated into a one-piece design.

While this invention has been described in terms of several embodiments, there are alterations, modifications, permutations, and substitute equivalents, which fall within the scope of this invention. It should also be noted that there are many alternative ways of implementing the methods and apparatuses of the present invention. It is therefore intended that the following appended claims be interpreted as including all such alterations, modifications, permutations, and substitute equivalents as fall within the true spirit and scope of the present invention.

What is claimed is:

1. A magazine well attachment for use with a firearm configured to operate with a tilt-lock magazine, the magazine well attachment comprising:

a well attachment body having a through slit configured to slide over a trigger guard of a firearm and enabling the trigger guard to enter a beveled well opening of the attachment body during assembly, and wherein the beveled well opening is configured to guide a tilt-lock magazine into a magazine opening of the firearm;

a front retainer configured to secure the magazine well attachment to a front portion of the magazine opening of the firearm;

at least on rear overhang configured to be sandwiched between and make contact with a receiver of the firearm and a ledge of a trigger guard of the firearm when attached to the firearm; and at least one fastener for securing the magazine well attachment to the trigger guard of the firearm.

2. The magazine well attachment of claim 1 wherein the front retainer is a clip coupled to the attachment body.

3. The magazine well attachment of claim 1 wherein the front retainer is an integral portion of the attachment body.

4. The magazine well attachment of claim 1 wherein the at least one rear overhang is oversized and configured to be custom fitted to the firearm.

5. The magazine well attachment of claim 1 wherein the beveled well opening includes a corresponding pair of beveled steps configured to funnel and center the magazine.

6. The magazine well attachment of claim 1 further comprising a magazine latch shield coupled to the magazine body.

7. The magazine well attachment of claim 1 further comprising a magazine latch shield and wherein the magazine latch shield is an integral portion of the magazine body.

8. The magazine well attachment of claim 1 further comprising at least one oversized shim configured to custom fitted the attachment body to the firearm.

9. The magazine well attachment of claim 1 wherein the beveled well opening includes an angled front well ramp configured to guide the magazine into the rifle.

10. The magazine well attachment of claim 9 wherein the front well ramp is angled at approximately 47.7 degrees from the horizontal magazine opening of the rifle.

* * * * *